US006601428B1

(12) United States Patent
Brenner

(10) Patent No.: US 6,601,428 B1
(45) Date of Patent: Aug. 5, 2003

(54) METHOD FOR PRODUCING A GEAR RACK, AND A STAMPING DEVICE FOR CARRYING OUT THE METHOD

(75) Inventor: Alfred Brenner, Heubach (DE)

(73) Assignee: ZF Lenksysteme GmbH, Schwaebisch Gmuend (DE)

( * ) Notice: Subject to any disclaimer, the term of this patent is extended or adjusted under 35 U.S.C. 154(b) by 0 days.

(21) Appl. No.: 09/786,021

(22) PCT Filed: Aug. 21, 1999

(86) PCT No.: PCT/EP99/06136

§ 371 (c)(1),
(2), (4) Date: Apr. 9, 2001

(87) PCT Pub. No.: WO00/12245

PCT Pub. Date: Mar. 9, 2000

(30) Foreign Application Priority Data

Aug. 29, 1998 (DE) ..... 198 39 428

(51) Int. Cl.[7] ..... B21K 1/76
(52) U.S. Cl. ..... 72/400; 29/893.34
(58) Field of Search ..... 72/399, 355.2, 72/356, 400; 29/893.36, 893.34, 893.33

(56) References Cited

U.S. PATENT DOCUMENTS 4,715,210 A 12/1987 Bishop et al. ..... 72/400
5,746,085 A * 5/1998 Harada et al. ..... 29/893.34
6,016,602 A * 1/2000 Kanemitsu et al. ..... 29/893.32

FOREIGN PATENT DOCUMENTS

| | | |
|---|---|---|
| DE | 32 02 254 | 7/1983 |
| DE | 197 26 697 | 1/1999 |
| EP | 0 110 918 | 8/1989 |
| EP | 0 897 767 | 2/1999 |
| JP | 57-206546 | 12/1982 |
| JP | 60-102247 | 6/1985 |
| WO | 95/16529 | 6/1995 |

* cited by examiner

*Primary Examiner*—Daniel C. Crane
(74) *Attorney, Agent, or Firm*—Kenyon & Kenyon

(57) ABSTRACT

A method for producing a blank for a gear rack for rack-and-pinion steering of motor vehicles includes the following steps: In a first step, a starting material having an essentially circular cross-section is placed into a stamping apparatus containing at least three form tools movable relatively to one another. In a second step, at least one force in at least one direction is exerted upon at least one of the form tools, the form tools moving relative to one another by this force, so that the starting material is reformed into a blank for the gear rack. At least in the axial region of the tooth system of the gear rack to be formed, the blank is provided with a shape differing from a circular cylinder. Using this method, part of the material of the starting material is displaced on one side from the middle into the region of the tooth system to be formed, without having much strain-hardening occur in this region. This makes subsequent production processes easier.

6 Claims, 3 Drawing Sheets

METHOD FOR PRODUCING A GEAR RACK, AND A STAMPING DEVICE FOR CARRYING OUT THE METHOD

FIELD OF THE INVENTION

The present invention relates to a method for producing a blank for a gear rack for rack-and-pinion steering of motor vehicles, and a stamping apparatus for carrying out the method.

BACKGROUND INFORMATION

German Published Patent Application No. 197 26 697. In this Patent, a method for producing a gear rack is. The blank for producing this gear rack has a shape differing from a circular cylinder at least in the region of its tooth system. Hitherto, such a blank could be produced, for example, by a machining process, by extruding, or by another forming process. During such a forming production process, considerable strain-hardening could occur in the blank in various regions. However, subsequent non-cutting forming processes are made considerably more difficult by such strain-hardening. It was possible to remedy this by introducing additional annealing processes between the individual forming processes. However, such heat treatment processes require an interruption in the cold forming from the starting material via the blank to the finished gear rack.

Further processing in a non-cutting method is described, for example, in German Published Patent Application No. 32 02 254. In this method, a gear rack is produced from a cylindrical starting material by orbital forging between a top die and a bottom die. In this method, too, strain-hardening may occur in the region of the tooth system of the gear rack, and this strain hardening makes the production of the gear rack more difficult.

Japanese Published Patent Application No. 57-206546 describes a stamping apparatus for forming a gear rack from a hollow-bar blank filled with an inherent substance during the shaping. The gear rack is provided with at least a partial tooth system. The stamping apparatus includes a plurality of form tools that are movable relative to one another and provide a forming effect on the hollow-bar blank due to the forces and reaction forces occurring in the process.

U.S. Pat. No. 4,715,210 describes a die for forming a Y-shaped gear-rack part by forging. The die includes a group of four forming elements that are arranged symmetrically about the longitudinal plane that corresponds to the plane of symmetry of the gear-rack part to be formed. At least three of these forming elements are movable relative to one another.

In the foregoing stamping devices, the form tools required for the shaping operation act on the gear-rack blank from different directions. Thus, forces from different directions must be compensated for by the apparatus. Housing parts of the apparatus must therefore be larger. In addition, the driving devices for the forming elements must also be relatively complicated and costly, which further requires a larger size of the apparatus.

It is an object of the present invention to produce a blank for a gear rack in such a way that, in particular in the region of the gear rack tooth system to be produced subsequently, only slight strain-hardening occurs. This region is therefore of great importance, since considerable flow movements of the material occur during the subsequent forming process, for example, an orbital process. Overall production costs may be sharply reduced by the method.

SUMMARY

In the method according to the present invention for producing a blank for a gear rack, using a stamping apparatus with at least three form tools which are movable relative to one another, in a first step, a starting material with an essentially circular cross-section is positioned between the form tools. In a second step, at least one force in at least one direction is then brought to bear on at least one of the form tools, by which the form tools move relatively to one another. Thus, the starting material is reformed into a blank for the gear rack which, at least in the axial direction of the gear rack tooth system, takes on a shape differing from that of a circular cylinder. Through the introduction of a force to at least one of the three form tools movable relative to one another, without major strain hardening, the starting material may be formed into those regions of the blank which experience greater deformations in the further course of producing the gear rack. An additional advantage of this method is that in a simple way a blank form can be achieved, with which the formation of burrs can be avoided during a subsequent reforming process, in particular with an orbital process.

The stamping apparatus according to the present invention may be used for performing this method. This apparatus includes at least three form tools which are movable relative to one another, of which one is fixed, while the other two are movable relative to each other and to the fixed form tool. Two of the form tools include effective surfaces, inclined to each other, which lie symmetrically to a plane of symmetry of the gear rack. This plane of symmetry is perpendicular to the tooth system of the gear rack, and contains the longitudinal axis of the gear rack. The third form tool includes an effective surface which extends perpendicular to the aforementioned plane of symmetry of the gear rack.

Using such a stamping apparatus, and with the use of the method according to the present invention, a blank for a gear rack may be produced without having to overcome major frictional forces during reforming from the starting material, and without the appearance of significant strain-hardening in critical regions.

Thus, during the second method step, a convex or concave longitudinal profile may be worked into the starting material, at least in the axial region of the gear rack tooth system at the circumference of the blank outside of the tooth system, the longitudinal profile, during further method steps, being used to absorb the orbital moments. During the second method step, in the tooth system region of the gear rack, the blank is provided with two surfaces positioned essentially symmetrical to each other, which can be flat or vaulted. The longitudinal profile may have various cross-sections, such as, for example, a circular segment, a rectangle, a triangle or a combination thereof.

In the stamping apparatus it is advantageous if only one of the three form tools is fixed. In this regard, the fixed form tool may be either one of the two form tools that are symmetrically arranged to the plane of symmetry, or it may be the form tool, the effective plane of which is arranged perpendicular to the plane of symmetry of the gear rack. If the two movable form tools are those that are symmetrically arranged with respect to the plane of symmetry of the gear rack, then these two form tools are each acted upon with the same force and the same speed in a direction perpendicular to the plane of symmetry of the gear rack. On the other hand, if the form tool, the effective plane of which extends perpendicular to the plane of symmetry, is one of the two movable form tools, this form tool is coupled with the other form tool so that it moves at half the speed of the other movable form tool.

In both cases this achieves that the plane of symmetry remains unchanged in its position opposite the form tool having its effective plane extending perpendicular to the plane of symmetry. Since the counterpart to the concave or convex longitudinal profile of the blank, respectively, is contained in this form tool, the longitudinal profile always remains in the plane of symmetry of the gear rack.

DETAILED DESCRIPTION

Figure 1:
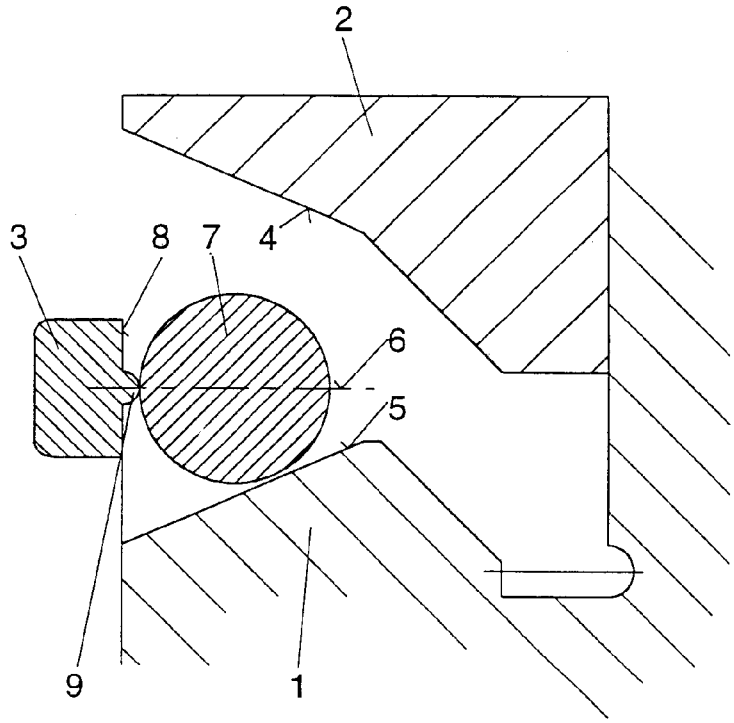
FIG. 1 is a cross-sectional side view of a stamping device according to the present invention.

The stamping apparatus according to the present invention includes three form tools, 1, 2 and 3, movable relative to one another. One of the form tools, in this case form tool 1, is fixed. The other two form tools 2 and 3 are movable relatively to each other and to form tool 1. The form tools 1 and 2 have effective areas 4 and 5 which are inclined towards one another and are arranged symmetrically to one another with respect to a plane of symmetry 6. The plane of symmetry 6 belongs to a starting material 7, which has an essentially circular cross-section. The plane of symmetry 6 is defined so that it lies perpendicular to the tooth system of the gear rack that is later formed from the starting material 7. In addition, the plane of symmetry 6 includes the longitudinal axis of the starting material 7 and thus of the gear rack to be formed therefrom. The form tool 3 has an effective area 8, which is perpendicular to the plane of symmetry 6.

A convex longitudinal profile 9 is formed on the effective area 8 of the form tool 3. In the exemplary embodiment, the longitudinal profile 9 has an approximately semicircular cross-section. However, the cross-section may be formed with the same effect by a triangle, a rectangle or a combination of all these shapes.

Figure 2:
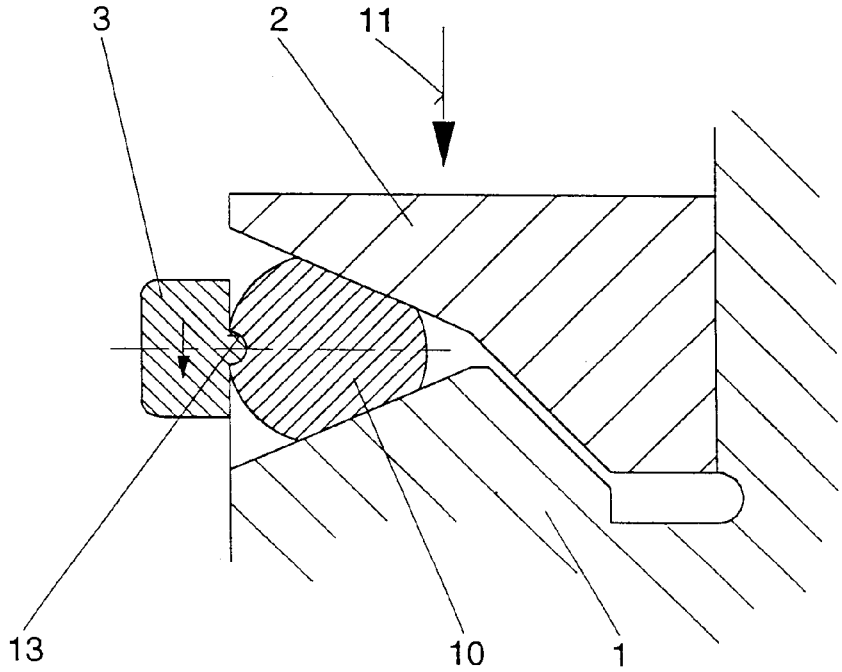
FIG. 2 is a cross-sectional side view of the stamping device illustrated in FIG. 1 in a position corresponding to an end of the manufacturing method.

In the exemplary embodiment illustrated in FIGS. 1 and 2, the two form tools 2 and 3, movable relative to each other, are coupled to each other so that the form tool 3 may be moved with half the speed of the form tool 2 during the actual forming process. The actual forming process begins as soon as the effective area 4 comes into contact with the outer contour of the starting material 7.

The end of the forming process is shown in FIG. 2. Both form tool 2 and form tool 3 are located in their respective end position, in which a blank 10 is formed from the starting material 7.

The function of the stamping apparatus, according to the present invention, for producing a blank for a gear rack for a rack-and-pinion steering system for motor vehicles is described below.

Figure 6:
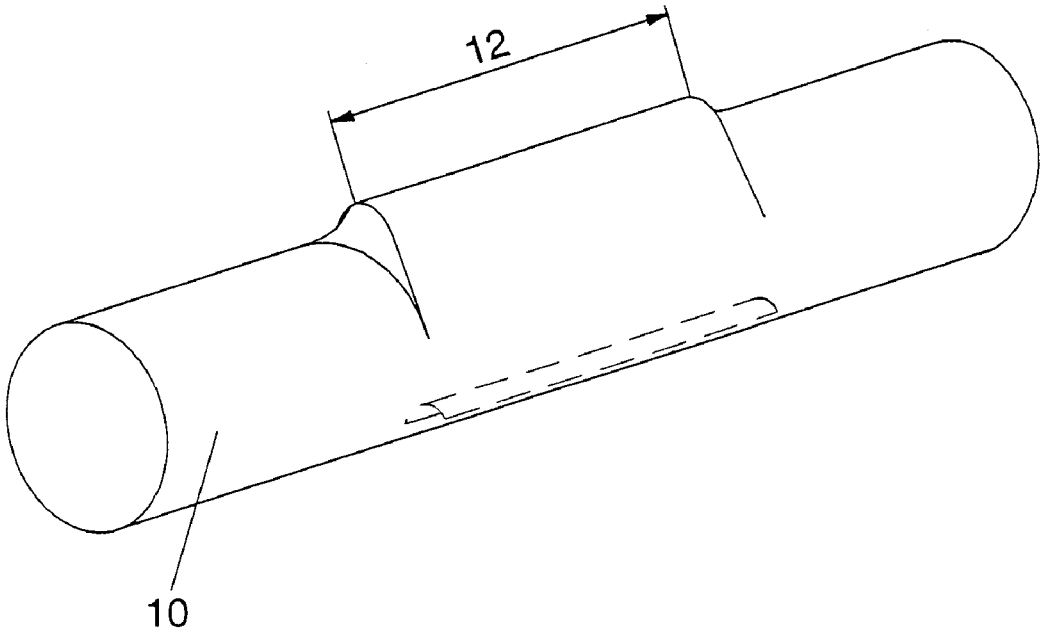
FIG. 6 is a perspective view of the blank for a gear rack.

In a first step, the starting material 7 having an essentially circular cross-section is inserted into the stamping apparatus between the form tools 1, 2 and 3. In a second step, a force is exerted on the form tool 2 in the direction of arrow 11. In the process, the form tool 3, which is coupled to form tool 2 in the manner described above, is moved so that the starting material 7 is given a shape differing from a circular cylinder, at least in an axial region 12. In FIG. 6, the axial region 12 is located where the tooth system of a gear rack, produced from the blank 10, is arranged.

During the second step, a concave longitudinal profile 13 is made in the starting material 7 by the convex longitudinal profile 9. The longitudinal profile 13 may be located in blank 10 in the plane of symmetry 6, i.e., on the side which is opposite to the tooth system of the gear rack to be later formed. During this second step of the method, the plane of symmetry 6 is displaced by half the travel of form tool 2 in the direction of form tool 1.

In a further step of the method, the gear rack is formed from blank 10 by, for example, orbital forging. The longitudinal profile 13 is made in blank 10 in order to be able to support the blank 10 relative to the orbiting moments during orbital forging.

Instead of the one longitudinal profile 13, the blank may also have two or more correspondingly smaller longitudinal profiles.

During the second step of the method, the blank 10, at least in the tooth system region of the gear rack, is provided with two flattenings 14 and 15, which are arranged essentially symmetrically to one another, are inclined towards one another and originate from the effective areas 4 and 5, inclined towards one another, of the form tools 2 and 1. If the effective areas 4 and 5 are not of planar design but are designed with different sectional areas which are at an angle to one another, the flattenings 14 and 15 may be provided with polygonal surfaces. Likewise, the flattenings 14 and 15 may be designed to be slightly crowned.

Figure 4:
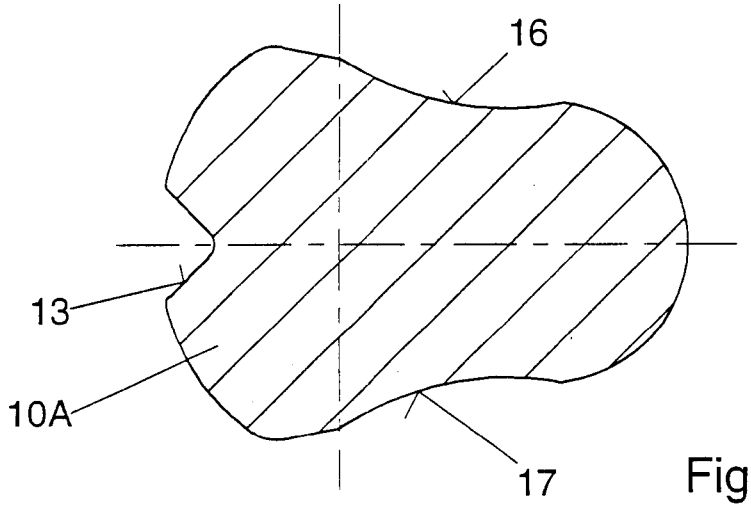
FIG. 4 is a cross-sectional view of a second example embodiment of a blank for a gear rack produced by the method according to the present invention.

In the embodiment of the blank 10A illustrated in FIG. 4, the effective areas 4 and 5 likewise have no flat areas but are of arched design. As a result, the blank 10A is provided with two constrictions 16 and 17, which are arranged essentially symmetrically to one another and are substantially restricted to the tooth system region of the gear rack to be later formed.

The angle between the flattenings 14 and 15 and the plane of symmetry 6 may be within a range between 12 degrees and 30 degrees, more particularly, the range may be, for example, 20 degrees plus/minus 5 degrees. These values also apply if the flattenings 14 and 15 are not designed as planar areas but as polygonal surfaces or as constrictions 16 and 17. In these cases, the ranges for the mean angles apply.

Figure 3:
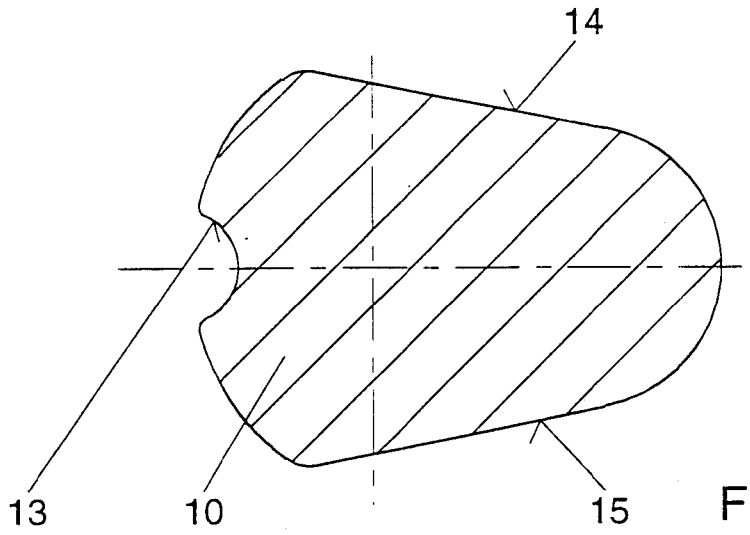
FIG. 3 is a cross-sectional view of a first example embodiment of a blank for a gear rack produced by the method according to the present invention.

In the embodiment of the blank illustrated in FIGS. 3 and 4, the longitudinal profile 13 is in each case of concave design. The longitudinal profile 13 is designed as a segment of a circle in FIG. 3 and as a triangular cross-section in FIG. 4.

Figure 5:
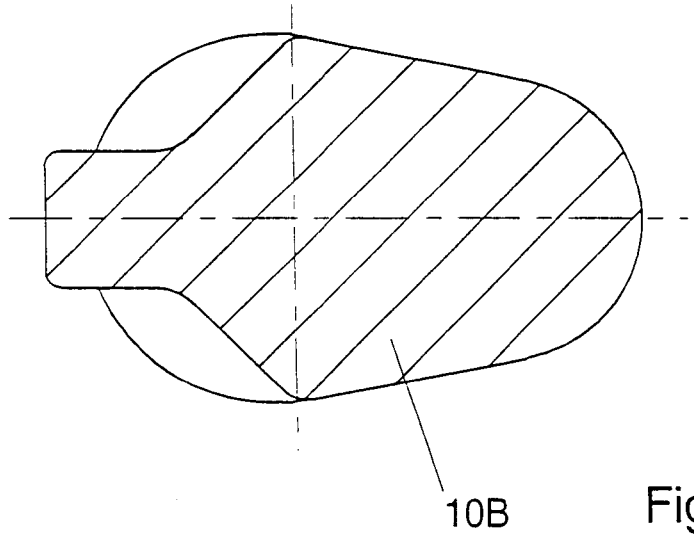
FIG. 5 is a cross-sectional view of a third example embodiment of a blank for a gear rack produced by the method according to the present invention.

FIG. 5 shows a gear rack blank 10B having a longitudinal profile of convex design, so that the blank is provided with a so-called Y cross-section.

It is essential in the case of all the blank shapes that there is a sufficiently large amount of material in the tooth system region of the gear rack to be formed in order to facilitate the forming of the tooth system. The starting material 7 is therefore formed substantially without strain-hardening so that material is displaced from the center primarily into the tooth system region. This results in the cross-section of the blanks 10, 10A, 10B which is shown in FIGS. 3 to 5 and differs from the circular shape.

Other variations and combinations of different longitudinal profiles 13, flattenings 14, 15 and constrictions 16, 17 are within the scope of the invention.

In a second example embodiment of the stamping apparatus, the form tools 1, 2 and 3 are designed in the same way as in the previously described example embodiment. Only the coupling of the two form tools movable relative to each other and to the third form tool is different. In this example embodiment, the form tools 1 and 2 are connected to one another so that they move in opposite directions towards the plane of symmetry 6. In this case, the form tool 3 is fixed.

Instead of a coupling between the two form tools 2 and 3 or 1 and 2, respectively, two forces acting independently of each other may be applied to the two form tools.

Which of the two form tools move relative to each other and to the third fixed form tool is not important for the production of the gear rack blank.

What is claimed is:

1. A stamping apparatus for producing a blank for a gear rack for a rack-and-pinion steering system of a motor vehicle, comprising:

at least three form tools movable relative to one another;

wherein at least one of the form tools is fixed and at least two of the other ones of the form tools are movable relative to one another and to the fixed form tool;

wherein at least two of the form tools include effective areas inclined toward one another and are arranged symmetrical with respect to a plane of symmetry of the gear rack, the plane of symmetry being arranged perpendicular to a tooth system region of the gear rack and including a longitudinal axis corresponding to the gear rack;

wherein at least one of the form tools includes an effective area that is arranged perpendicular to the plane of symmetry of the gear rack; and wherein the other ones of the form tools are movable substantially only perpendicularly to the plane of symmetry of the gear rack, at least one of the other ones of the form tools including the effective area arranged symmetrically with respect to the plane of symmetry of the gear rack.

2. The stamping apparatus according to claim 1, wherein a first one of the other ones of the form tools includes the effective area arranged symmetrically with respect to the plane of symmetry of the gear rack and wherein a second one of the other ones of the form tools includes the effective area arranged perpendicularly with respect to the plane of symmetry of the gear rack.

3. The stamping apparatus according to claim 1, wherein an angle formed between the effective areas of the form tools inclined toward one another and the plane of symmetry is within a range of 12° and 30°.

4. The stamping device according to claim 3, wherein the range is approximately 20°±50°.

5. A stamping apparatus for producing a blank for a gear rack for a rack-and-pinion steering system of a motor vehicle, comprising:

at least three form tools movable relative to one another;

wherein at least one of the form tools is fixed and at least two of the other ones of the form tools are movable relative to one another and to the fixed form tool;

wherein at least two of the form tools include effective areas inclined toward one another and are arranged symmetrical with respect to a plane of symmetry of the gear rack, the plane of symmetry being arranged perpendicular to a tooth system region of the gear rack and including a longitudinal axis corresponding to the gear rack;

wherein at least one of the form tools includes an effective area that is arranged perpendicular to the plane of symmetry of the gear rack;

wherein the other ones of the form tools are movable substantially only perpendicularly to the plane of symmetry of the gear rack, at least one of the other ones of the form tools including the effective area arranged symmetrically with respect to the plane of symmetry of the gear rack; and wherein the other ones of the form tools are coupled to each other so that the form tool including the effective area arranged perpendicular to the plane of symmetry of the gear rack is movable at half of a speed of the other movable form tool.

6. The stamping device according to claim 5, wherein the effective area of at least one of the form tools includes one of a convex and a concave longitudinal profile having a cross-section that includes at least one of a circle segment, a triangle and a rectangle.

* * * * *

UNITED STATES PATENT AND TRADEMARK OFFICE

CERTIFICATE OF CORRECTION

PATENT NO. : 6,601,428 B1
DATED : August 5, 2003
INVENTOR(S) : Alfred Brenner

It is certified that error appears in the above-identified patent and that said Letters Patent is hereby corrected as shown below:

Column 1,
Line 13, after "197 26 697" delete ". In" and insert -- describes -- therefor;
Line 14, delete "this Patent," and "is";

Column 4,
Line 46, change "degrees, more" to -- degrees. More --; and

Column 6,
Line 10, change "20º±50º" to -- 20º±5º --.

Signed and Sealed this

Thirty-first Day of August, 2004

JON W. DUDAS
*Director of the United States Patent and Trademark Office*